United States Patent [19]

van Heijst

[11] 4,069,529

[45] Jan. 24, 1978

[54] SINGLE-POINT MOORING BUOY

[75] Inventor: Willem Jan van Heijst, Monte-Carlo, Monaco

[73] Assignee: Single Buoy Moorings, Inc., Fribourg, Switzerland

[21] Appl. No.: 687,755

[22] Filed: May 19, 1976

[30] Foreign Application Priority Data

May 23, 1975 Netherlands ..... 7506107

[51] Int. Cl.[2] ..... B63B 21/52

[52] U.S. Cl. ..... 9/8 P; 114/230; 141/388

[58] Field of Search ..... 9/8 P, 8 R; 114/230; 285/134; 141/387, 388; 61/94, 95

[56] References Cited

U.S. PATENT DOCUMENTS

| | | | |
|---|---|---|---|
| 3,614,869 | 10/1971 | Flory et al. | 114/230 |
| 3,700,014 | 10/1972 | Scales et al. | 9/8 P |
| 3,722,223 | 3/1973 | Gratz | 114/230 |
| 3,750,723 | 8/1973 | Schirtzinger | 141/388 |
| 3,823,432 | 7/1974 | Van Heijst | 9/8 P |
| 3,894,567 | 7/1975 | Mott et al. | 9/8 P |

*Primary Examiner*—Trygve M. Blix
*Assistant Examiner*—Stuart M. Goldstein
*Attorney, Agent, or Firm*—Young & Thompson

[57] ABSTRACT

A single-point mooring buoy comprises a vertical column which is secured at its lower end to the sea floor. The buoy is connected to the column for rotation relative to the column through 360° about a vertical axis. A conduit extends from the lower end of the column to a swivel joint connection for a hose on the column. The buoy is mounted on the column by its own bearing, which is below that swivel joint assembly. There is a passage through the buoy in alignment with the column, which extends from above the water level to below the swivel joint.

7 Claims, 4 Drawing Figures

11
5
4
7
4
8
6
9
1
2
10
3
9

SINGLE-POINT MOORING BUOY

The present invention relates to a single-point mooring buoy, comprising a column, which, in the operative position extends substantially vertically, said column may be anchored to a bottom lying under the water surface with the aid of means provided at its lower end, a buoy member connected with said column in such a way that said member may rotate through 360° about said column, and at least one conduit extending from a point near the anchoring of the column towards a swivel joint assembly also connected with the column for rotation through 360° to which a hose or similar element may be connected.

A mooring buoy of this kind is known from U.S. patent application Ser. No. 856,445 now U.S. Pat. No. 3,641,602.

A single-point mooring buoy is used in particular for mooring a tanker outside the harbour, said vessel being generally secured to merely one mooring buoy by means of bow ropes, so that said buoy may turn freely through 360° due to the influence of currents, waves or the wind. A tanker moored in this way may then be loaded or unloaded via the hose connected to the swivel joint assembly.

Usage of the mooring buoy causes wear of the movable parts of said buoy. Wear of the swivel joint assembly may cause leakage, which is highly undesirable since a considerable amount of oil may, thus, flow into the sea. A swivel joint assembly which is worn out or which, generally, does not function properly any more must therefore be repaired or renewed within a very short period of time.

In the known single-point mooring buoy the buoy member is connected with the swivel joint mounted on the upper end portion of the column by means of chains. This means that in order to repair or renew said swivel joint, first of all the buoy member must be disengaged, which is a time-consuming operation.

It is the object of this invention to provide a single-point mooring buoy, in which the swivel joint assembly may be repaired or renewed in an easy and fast manner.

Said object is achieved in that with the single-point mooring buoy according to the invention the buoy member is mounted on the column by means of a bearing of its own, and that said bearing is disposed below the swivel joint assembly.

In this way the swivel joint assembly is directly accessible and the buoy member need not be released for repair of the swivel joint.

A passage may advantageously be provided through the buoy member, said passage extending in alignment with the column. Cables for example may be passed through said passage by which the swivel joint may be hoisted and lowered also through the passage.

The passage is preferably embodied in such a way that the upper side of the passage lies above the water level and the lower side below the swivel joint, in which at said lower side a base structure is present, said structure enclosing the column.

Upon pumping out the passage the swivel joint assembly may then be replaced or repaired in dry surroundings. In addition, leakage of the swivel joint may rapidly be discovered, as the leaking oil is held back in the passage. Said oil may also be forced back into the conduit by means of a pump so that loading or unloading of a vessel may also be completed with a leaking swivel joint said swivel joint being replaced or repaired afterwards.

The invention will now be discussed in more detail with reference to the accompanying drawings, wherein.

Figure 1:
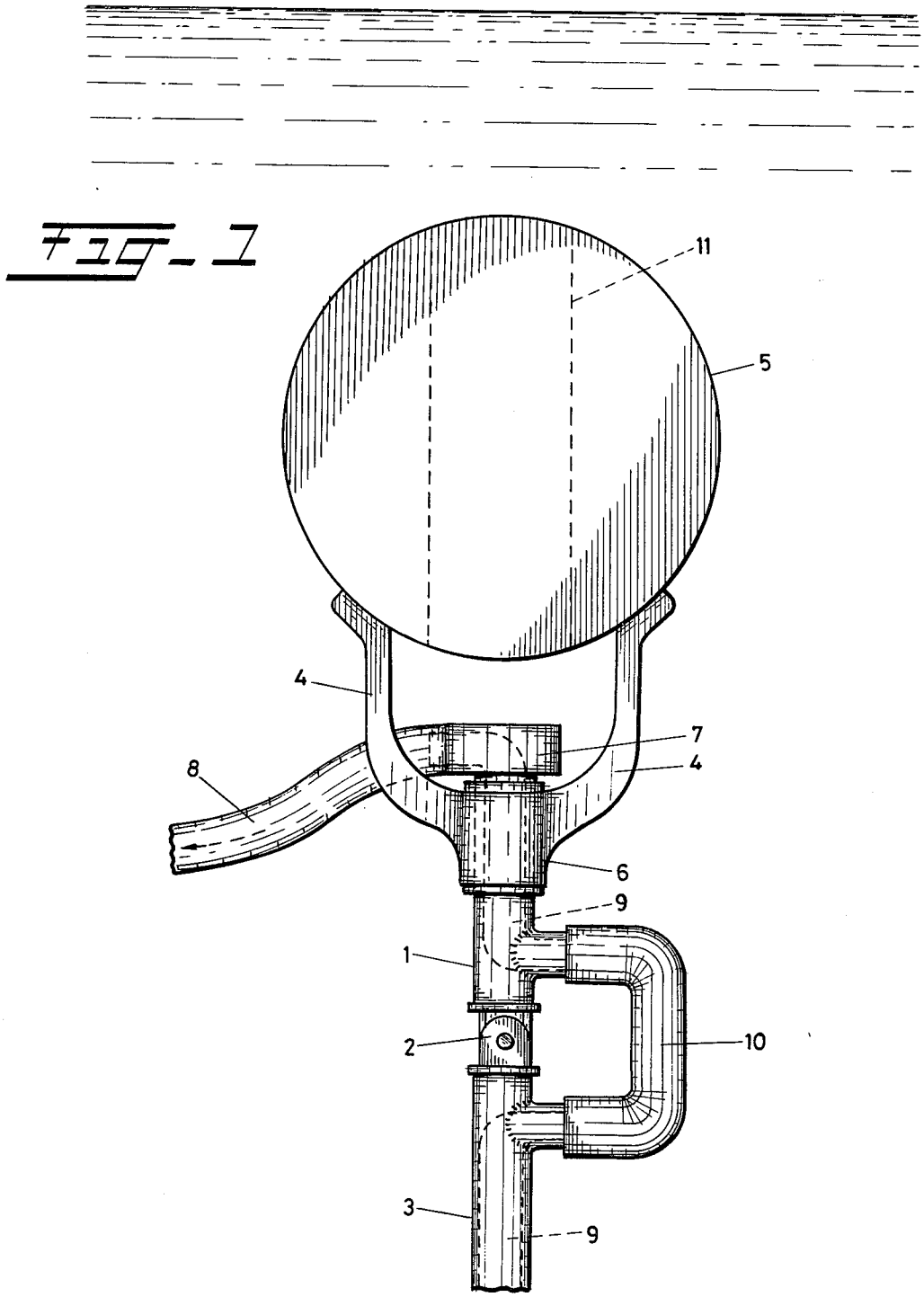
FIG. 1 is a side elevation of the upper part of a single-point mooring buoy in accordance with the invention.

The single-point mooring buoy illustrated in FIG. 1 comprises a column 1, which by means of the universal joint 2 is connected with an extension 3, said extension at the lower end (not illustrated) being anchored to the bottom lying below the water level. A bearing 6, rigidly connected to the buoy member 5 by means of arms 4, is mounted on column 1 so that the buoy member 5 may turn freely through 360°. A swivel joint assembly 7 is provided on the upper side of column 1; a hose 8 may be connected to one side of said swivel joint, which at its other side communicates with the conduit 9, said conduit extending through column 1 and the extension 3 towards the anchor and being guided around the universal joint 2 via a flexible by-pass 10.

Thus, swivel joint assembly 7 is separated from bearing 6 of the buoy member 5 and is situated above said bearing 6 so that said swivel joint 7 may be renewed or repaired without the necessity of dismounting buoy member 5.

A passage 11 may be provided through buoy member 5, as a result of which the swivel joint assembly 7 may be hoisted through said passage 11.

Figure 2:
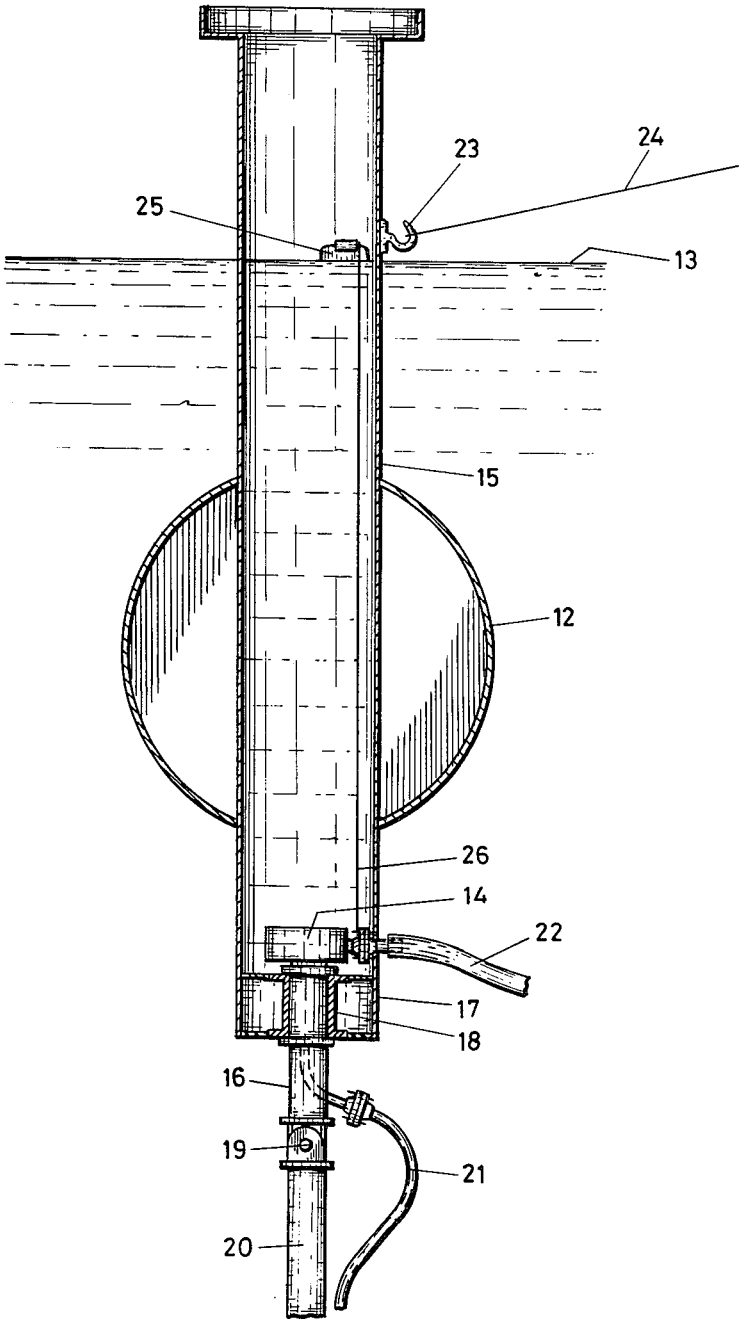
FIG. 2 is a cross-sectional view of the upper part of a different embodiment of a single-point mooring buoy in accordance with the invention.

In the embodiment illustrated in FIG. 2 the passage through buoy member 12 is extended upwardly and downwardly, constituting a passage shaft 15 running from above the water level 13 to below the swivel joint 14. Said shaft 15 is closed at its lower end by a base structure 17 enclosing column 16, said structure constituting also the bearing 18 for buoy member 12. Column 16 is connected with an extension 20 by means of a universal joint 19. The conduit is constructed in the form of a flexible pipe line 21 extending along the extension 20 and a hose 22 may be attached to swivel joint assembly 14. A hook 23 is secured to the passage shaft 15 for mooring a vessel with the aid of mooring cable 24.

With said embodiment the passage shaft 15 can be emptied by pumping so that the swivel joint 14 may be repaired in dry surroundings. In addition, any oil that may have leaked from the swivel joint 14 may be pumped back into conduit 21 of hose 22 by means of an oil pump 25 and a pressure pipe 26 so that even with a leaking swivel joint 14 the operation can be continued without the risk that leaking oil flows into the sea.

In addition, a cover (not shown) may be provided on the upper side of the passage shaft 15 so that said shaft remains dry and may be under pressure, if necessary.

Figure 3:
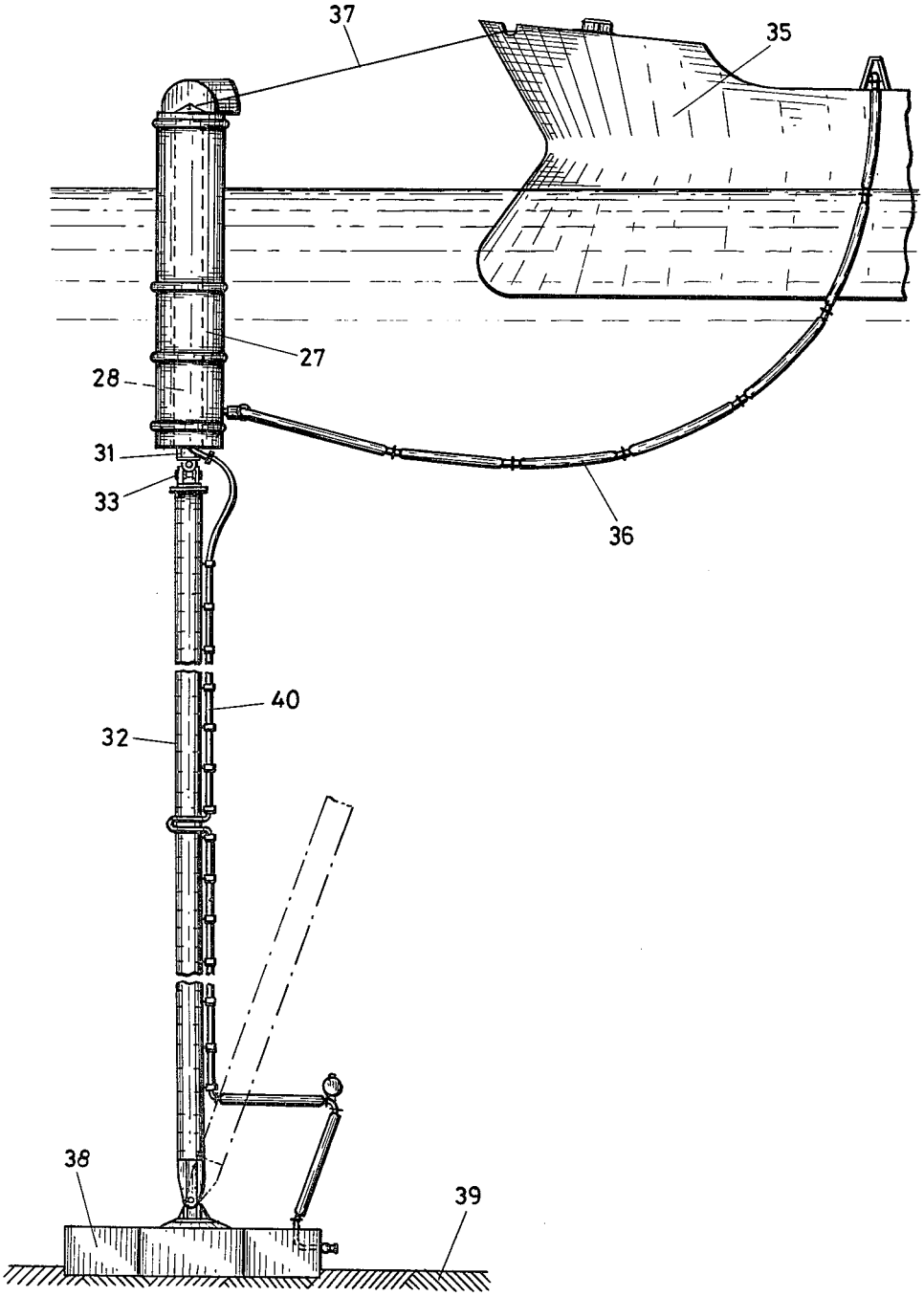
FIG. 3 is an elevation of a complete single-point mooring buoy of the type illustrated in FIG. 2.
Figure 4:
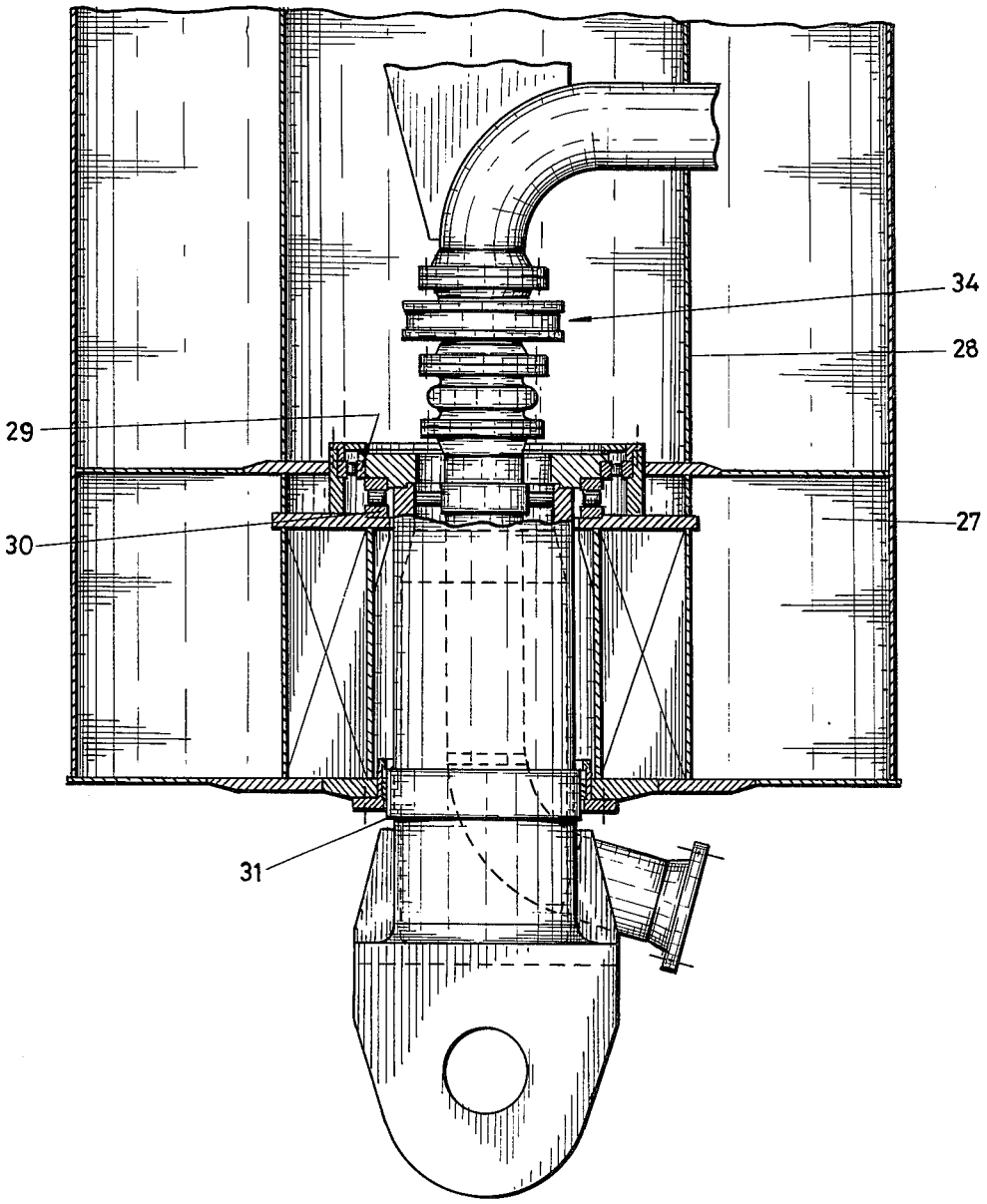
FIG. 4 is a cross-sectional view on a larger scale of the swivel joint assembly and the bearing of the buoy member of the single-point mooring buoy according to FIG. 3.

In the embodiment illustrated in FIGS. 3 and 4 the passage shaft 28 is fully enclosed by the buoy member 27. Said buoy member is rotatably mounted on column 31 by means of the radial and axial bearings 29 and 30 respectively, said column being connected with extension 32 by a universal joint 33. A swivel joint assembly 34 is disposed on column 31 and a hose 36 extending to the vessel 35 is adapted to be connected to said swivel joint, said vessel being fastened to buoy member 27 by means of the bow rope 37. Extension 32 is hinged at its lower end to an anchoring base 38, said base being anchored to the sea floor 39. A conduit 40 extends from swivel joint assembly 34 along extension 32 towards the anchoring base 38.

Also in this embodiment any leaked oil is retained inside the buoy member, which oil may be pumped away while passage shaft 28 may be emptied by pumping and any leak gap in the bearing structure 29 and 30 may be sealed by means of an inflated torus so that the swivel joint assembly 34 may be repaired in dry surroundings.

What is claimed is:

1. A single point mooring buoy, comprising an upright column, an anchor by which the lower end of the column is held to the floor of a body of water, a buoy connected to the upper end of the column, a first swivel joint by which said buoy is interconnected to said column for rotation through 360° relative to said column about an upright axis, a second swivel joint carried by the upper end of said column adjacent the bottom of said buoy, a hose connected to said second swivel joint for rotation of said hose through 360° relative to said column about an upright axis, and at least one conduit extending from adjacent said anchor up along said column through said second swivel joint to said hose connecting means, said first swivel joint being disposed below said second swivel joint.

2. A single point mooring buoy as claimed in claim 1, said buoy having a passageway therethrough in alignment with said column.

3. A single point mooring buoy as claimed in claim 2, the upper end of said passageway extending above the water level and the lower end of said passageway extending below said second swivel joint.

4. A single point mooring buoy as claimed in claim 1, and a universal joint between said anchor and said column.

5. A single point mooring buoy as claimed in claim 1, and a universal joint adjacent the upper end of said column below said first swivel joint.

6. A single point mooring buoy as claimed in claim 1, in which said at least one conduit extends through said first swivel joint.

7. A single point mooring buoy as claimed in claim 1, there being a first universal joint between the lower end of said column and said anchor, and a second universal joint adjacent the upper end of the column below said first swivel joint, said at least one conduit extending from said anchor past said first and second universal joints and through said first swivel joint.

* * * * *